US010890128B2

(12) United States Patent
Na

(10) Patent No.: US 10,890,128 B2
(45) Date of Patent: Jan. 12, 2021

(54) PCSV CONTROL METHOD FOR PREVENTING MALFUNCTION

(71) Applicants: HYUNDAI MOTOR COMPANY, Seoul (KR); KIA MOTORS CORPORATION, Seoul (KR)

(72) Inventor: Jung-Wook Na, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/673,063

(22) Filed: Nov. 4, 2019

(65) Prior Publication Data

US 2020/0182168 A1 Jun. 11, 2020

(30) Foreign Application Priority Data

Dec. 7, 2018 (KR) ..... 10-2018-0156726

(51) Int. Cl.

| | |
|---|---|
| ***F02D 41/00*** | (2006.01) |
| ***F02D 41/06*** | (2006.01) |
| ***F02M 25/08*** | (2006.01) |
| ***F02D 41/04*** | (2006.01) |

(52) U.S. Cl.

CPC ..... *F02D 41/004* (2013.01); *F02D 41/042* (2013.01); *F02D 41/062* (2013.01); *F02D 41/064* (2013.01); *F02M 25/089* (2013.01); *F02M 25/0836* (2013.01); *F02D 2200/021* (2013.01); *F02D 2200/101* (2013.01); *F02M 2025/0863* (2013.01)

(58) Field of Classification Search

CPC .. F02D 41/0035; F02D 41/004; F02D 41/042; F02D 41/062; F02D 41/064; F02M 25/0818; F02M 25/0836; F02M 2025/0845; F02M 2025/0863

USPC ..... 701/113; 123/399, 520

See application file for complete search history.

(56) References Cited

U.S. PATENT DOCUMENTS

| | | | | |
|---|---|---|---|---|
| 7,503,311 | B2 * | 3/2009 | Nichols | F02D 11/107 123/361 |
| 7,673,619 | B2 * | 3/2010 | Park | F02D 41/0042 123/520 |
| 7,809,491 | B1 * | 10/2010 | Bevan | F02D 41/0032 123/480 |
| 9,518,540 | B2 * | 12/2016 | Pearce | B60W 10/06 |
| 10,100,751 | B2 * | 10/2018 | Mantovano | F02B 37/00 |
| 10,612,479 | B1 * | 4/2020 | Dudar | B60K 15/03519 |
| 2006/0278202 | A1 * | 12/2006 | Sieber | F02D 41/0032 123/520 |
| 2018/0313289 | A1 | 11/2018 | Na | |
| 2019/0055905 | A1 * | 2/2019 | Dudar | F02D 41/003 |

FOREIGN PATENT DOCUMENTS

KR 10-2018-0120430 A 11/2018

* cited by examiner

*Primary Examiner* — Erick R Solis

(74) *Attorney, Agent, or Firm* — Brinks Gilson & Lione

(57) ABSTRACT

A Purge Control Solenoid Valve (PCSV) control method for preventing malfunction may include: starting-up by a starting motor a crankshaft of an engine, and opening PCSV by a duty-control, wherein in the starting-up step, the PCSV is opened to eliminate foreign substances stained on the PCSV.

13 Claims, 5 Drawing Sheets

PCSV CONTROL METHOD FOR PREVENTING MALFUNCTION

CROSS-REFERENCE TO RELATED APPLICATION

This application claims priority to and benefit of Korean Patent Application No. 10-2018-0156726, filed on Dec. 7, 2018, the entire contents of which are incorporated herein by reference.

FIELD

The present disclosure relates to a Purge Control Solenoid Valve (PCSV) control method for inhibiting or preventing malfunction.

BACKGROUND

The statements in this section merely provide background information related to the present disclosure and may not constitute prior art.

Evaporated gas is generated in a fuel tank according to the changes in pressure and temperature. When the evaporated gas is accumulated more than necessary, the internal pressure of the fuel tank can be increased more than necessary. As the internal pressure of the fuel tank increases, the fuel tank can be damaged or the evaporated gas can be leaked from the fuel tank.

Therefore, a canister in which the activated carbon is contained is connected to the fuel tank to absorb the evaporated gas to the activated carbon. The evaporated gas absorbed to the activated carbon flows into an intake pipe, and is combusted in a combustion chamber. A PCSV is mounted between the canister and the intake pipe. As the PCSV is opened, the negative pressure generated in the intake pipe operates on the canister, and the evaporated gas absorbed to the activated carbon flows into the intake pipe by the negative pressure.

Meanwhile, a compressor for compressing the intake air can be mounted on the intake pipe. In this case, since the intake air is compressed by the compressor, the internal pressure of the intake pipe becomes the state that is equal to the atmospheric pressure or greater than the atmospheric pressure. A check valve is provided between the intake pipe and the PCSV in order to prevent the intake air from flowing from the intake pipe toward the canister.

However, we have discovered that the foreign substances stained on the PCSV caused by the heat generated in the engine at the time of traveling are likely to be phase-converted into liquid. After traveling, the foreign substances in the liquid phase can be condensed with water droplets, or can be hardened and fixed on the surface of the PCSV. Particularly, when the temperature difference between the surfaces of the PCSV before and after traveling is large, the foreign substances in the liquid phase can also be phase-converted into ice on the surface of the PCSV. The foreign substances that are condensed or fixed on the surface of the PCSV or are phase-converted into ice can fix the state of the PCSV, thereby causing malfunction or non-operation.

In addition, we have also found that when a vehicle in which the compressor is mounted on the intake pipe is stopped, the inside of a line for connecting the check valve and the PCSV becomes a negative pressure state by the fluctuation of the internal pressure of the intake pipe due to the stop of the compressor, the directionality of the check valve, and non-operation of the PCSV. The negative pressure generated inside the line for connecting the check valve and the PCSV operates so that the foreign substances can be absorbed to the airtight portion of the PCSV more strongly.

SUMMARY

The present disclosure provides a PCSV control method for preventing malfunction, which can inhibit or prevent the malfunction or non-operation of a PCSV due to the foreign substances fixed to the surface of the PCSV upon stopping.

In addition, the present disclosure provides a PCSV control method for preventing malfunction, which can eliminate the negative pressure generated inside the line for connecting a check valve and a PCSV upon stopping an engine.

A Purge Control Solenoid Valve (PCSV) control method for preventing malfunction includes: starting-up, by a starting motor, a rotation of a crankshaft of an engine; and opening the Purge Control Solenoid Valve (PCSV) by a duty-control, wherein the PCSV is opened to eliminate foreign substances stained on the PCSV.

In addition, in the starting-up, when a temperature of coolant of the engine or a temperature of a region where a is located is smaller than an appropriate value, or exceeds a threshold, the PCSV can be duty-controlled to be closed.

In addition, in the starting-up, when an operating time point of the starting motor is smaller than a specific time from a time point when the rotation of the crankshaft has been stopped, the PCSV can be duty-controlled to be closed.

In addition, in the starting-up, the PCSV can maintain the opened state for a certain time from a rotation starting time point of the crankshaft.

In addition, the certain time can be shorter than the time between the rotation starting time point of the crankshaft and the time point when the engine is started-up and then RPM of the engine is stabilized.

In addition, in the starting-up, the PCSV can be duty-controlled to become a predetermined opening amount.

In addition, the PCSV control method for preventing malfunction can further include: stopping the engine and controlling the PCSV to be opened and closed with a cycle via a duty-control. In particular, in the stopping the engine, the PCSV can be controlled to repeat the opening and closing with the cycle so as to eliminate a negative pressure between the PCSV and an intake pipe.

In addition, a compressor for compressing an intake air can be mounted on the intake pipe, and a check valve for preventing the intake air from flowing into the PCSV side from the intake pipe can be mounted between the PCSV and the intake pipe. In particular, in the stopping the engine, while repeating opening and closing the PCSV with the cycle, the negative pressure between the check valve and the PCSV can become an atmospheric pressure.

In addition, in the stopping the engine, the PCSV can be duty-controlled to be opened and closed at least once with any cycle from a time point when the rotation of the crankshaft has been stopped.

In addition, in the stopping the engine, the PCSV can be duty-controlled to be opened and closed at least once with any cycle from the time point when the rotation of the crankshaft has been stopped and a specific time has elapsed.

In addition, in the stopping the engine, the time that maintains the opened state and the closed state while the PCSV is opened and closed with any cycle can be 0.

In addition, in the stopping the engine, the PCSV can be duty-controlled to be opened and closed with a cycle after the engine is started off and any time has elapsed.

The present disclosure provides a control unit for operating the PCSV according to the PCSV control method for preventing malfunction. The controller can processes at least one function or operation and may be embodied in a hardware manner (e.g., a processor), a software manner, or a combination of the hardware manner and the software manner that process the PCSV control method to be described below in detail.

According to the PCSV control method for inhibiting or preventing malfunction in an exemplary form of the present disclosure configured as described above, in the starting-up, it is possible for the PCSV to be opened and closed to eliminate the foreign substances stained on the surface of the PCSV while stopping, thereby inhibiting or preventing the malfunction or non-operation of the PCSV caused by the foreign substances fixed to the surface of the PCSV upon stopping.

In addition, in the stopping, it is possible for the PCSV to be opened and closed to have a cycle to eliminate the negative pressure between the PCSV and the intake pipe, and thereby to allow the negative pressure generated inside the line for connecting the check valve and the PCSV to operate on the airtight portion of the PCSV, thereby preventing the foreign substances from being absorbed more strongly.

In addition, in the starting-up and the in the stopping, it is possible to operate the PCSV for a short time, thereby generating less noise.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
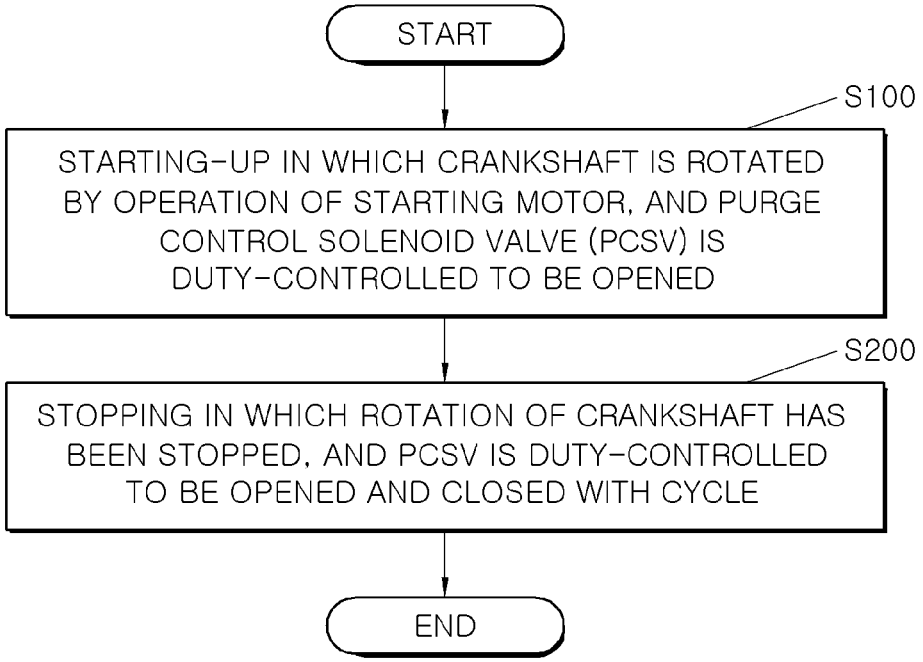
FIG. 1 is a flowchart of a PCSV control method for preventing malfunction in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a PCSV control method for preventing malfunction in one form of the present disclosure will be described with reference to the accompanying drawings.

As illustrated in FIGS. 1 to 5, a PCSV control method for preventing malfunction according to an exemplary form of the present disclosure includes: starting-up in which a crankshaft C is rotated by an operation of a starting motor S, and a Purge Control Solenoid Valve (PCSV) 100 is duty-controlled to be opened S100, and stopping an engine in which the engine is started off, and the PCSV 100 is duty-controlled to be opened and closed with a cycle S200, and in the starting-up S100, the PCSV 100 is opened to eliminate the foreign substances stained on the PCSV 100, and in the stopping S200, the PCSV 100 is opened and closed to have a cycle to eliminate the negative pressure between the PCSV 100 and an intake pipe I.

In the starting-up S100, as the PCSV 100 is opened and closed, the foreign substances that are condensed or hardened and fixed on the surface of the PCSV 100, or are phase-converted into ice are separated from the surface of the PCSV 100. The foreign substances are separated from the surface of the PCSV 100, thereby inhibiting or preventing the fixing of the PCSV 100 caused by the foreign substances, and preventing the malfunction or non-operation of the PCSV 100.

In the starting-up S100, the non-operation condition is substituted to restrict the operation of the PCSV 100 in the starting-up S100. The non-operation condition includes a temperature of coolant, the temperature of the outside air, and the stopping time. In the starting-up S100, when the temperature of the coolant of an engine E having a crankshaft C or the temperature of the region where a vehicle having the engine E is located is smaller than −5.25° C., or exceeds 20° C., the PCSV 100 is duty-controlled to maintain the closed state without opening. In the starting-up S100, when the stopping time that is the operating time point of the starting motor S from the time point when the rotation of the crankshaft C has been stopped is smaller than 2 hours, the PCSV 100 is duty-controlled to be closed without opening.

Figure 2:
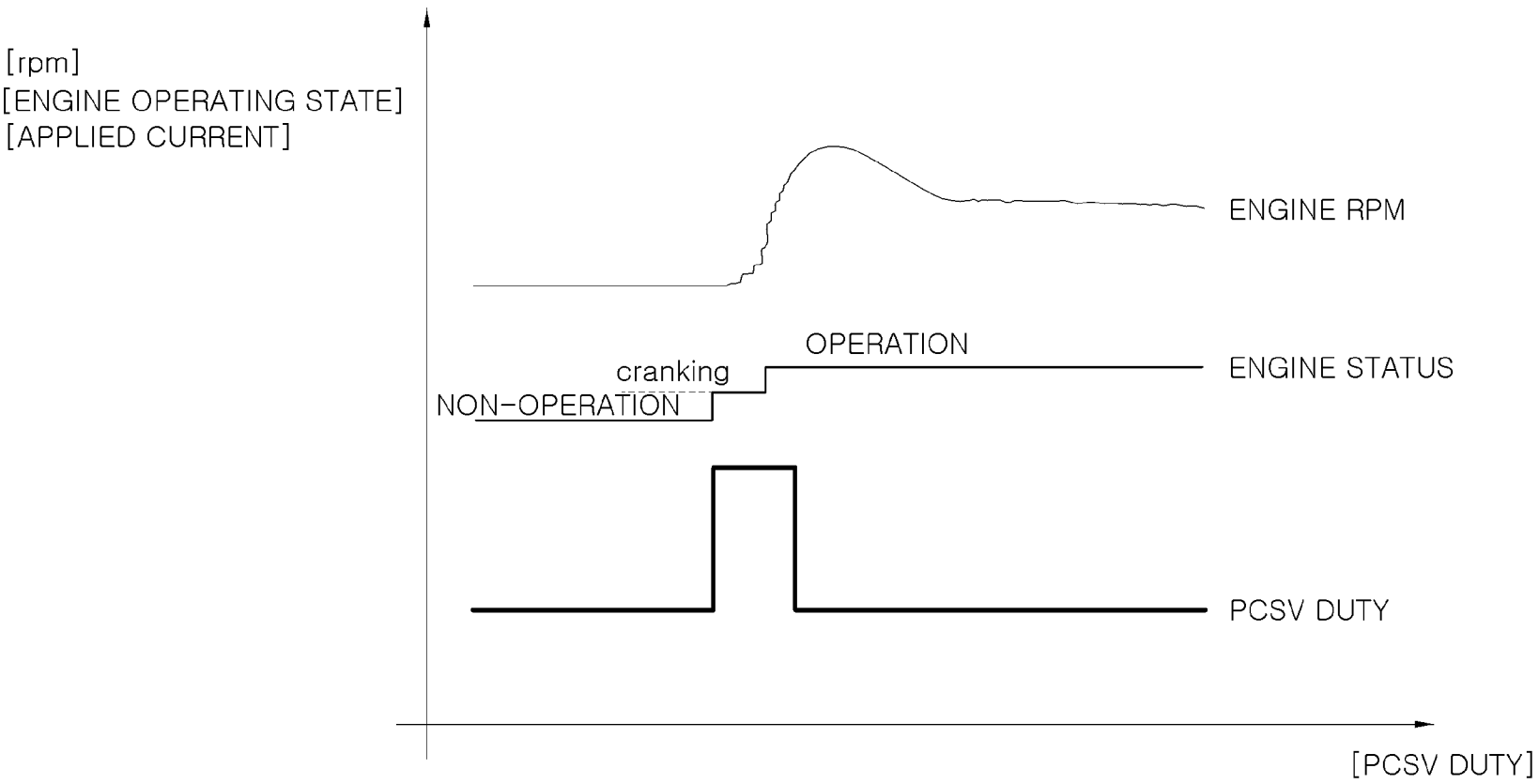
FIG. 2 is a graph illustrating the starting-up of FIG. 1.

In the starting-up S100, the PCSV 100 is duty-controlled so that a current is applied thereto to have the opening amount of 80% to 100%. In the starting-up S100, the PCSV 100 is controlled to maintain the opened state for a specific time from the rotation starting time point of the crankshaft C. As illustrated in FIG. 2, in the starting-up S100, the PCSV 100 is controlled to be opened for 0.4 to 0.6 seconds from the rotation starting time point of the crankshaft C.

Figure 5:
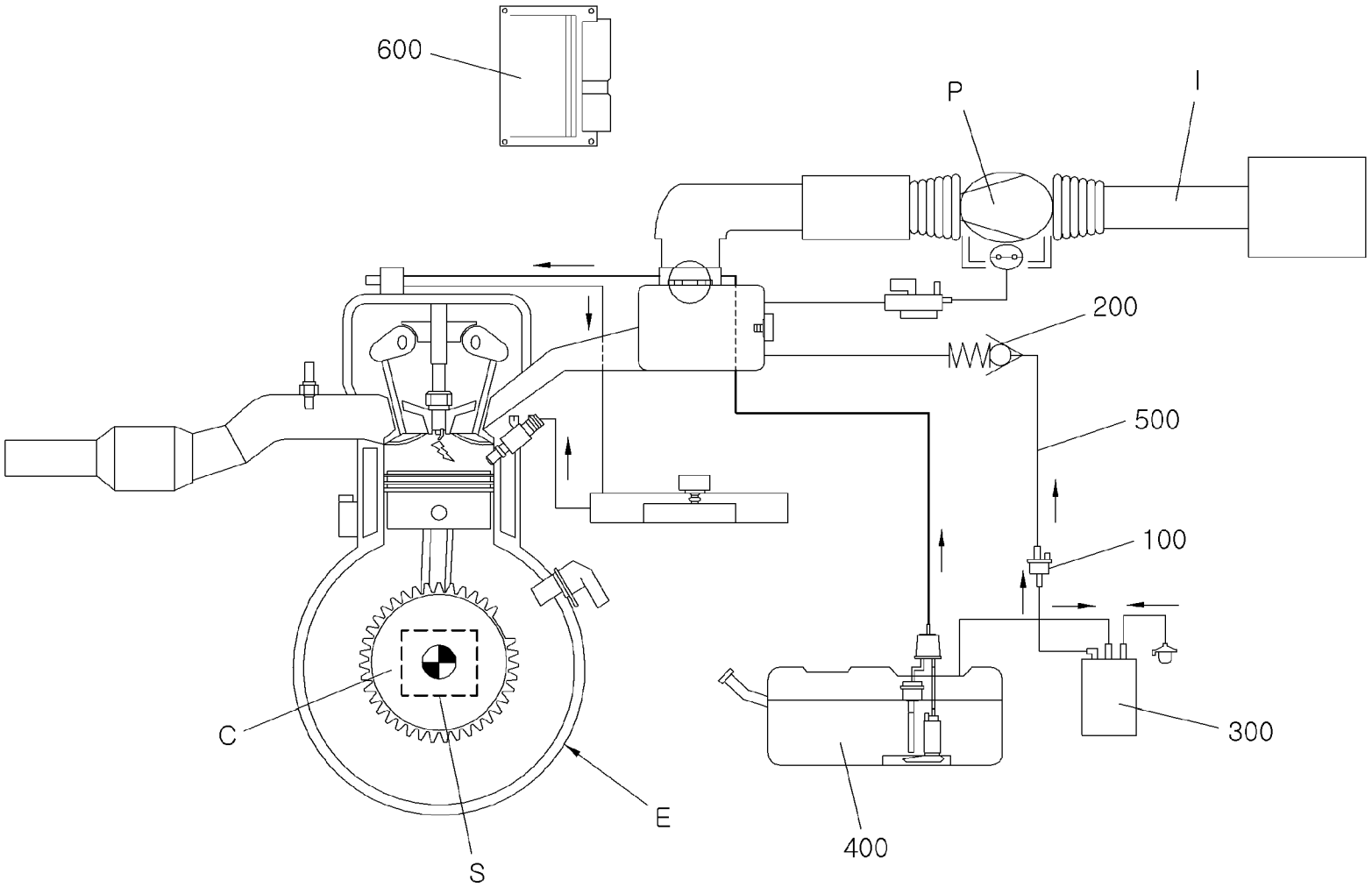
FIG. 5 is an exemplary diagram of a system to which the PCSV control method for preventing malfunction of FIG. 1 is applied.

As illustrated in FIG. 5, a system to which the PCSV 100 control method for preventing malfunction in one form of the present disclosure is applied includes: a canister 300 for absorbing the evaporated gas evaporated in a fuel tank 400, a purge line 500 for connecting the fuel tank 400, the canister 300, and the intake pipe I, the PCSV 100 mounted on the purge line 500, a check valve 200 mounted on the purge line 500 to be interposed between the intake pipe I and the PCSV 100, and a compressor P mounted on the intake pipe I to compress the intake air. The check valve 200 prevents the intake air from flowing into the PCSV 100 and the rear end of the PCSV 100 from the intake pipe I. The check valve 200 is mounted on the purge line 500 so that the evaporated gas flows only toward the intake pipe I from the PCSV 100.

When an operation of the compressor P is stopped as the engine E is started off, the air that has been compressed in the intake pipe I flows backward through the intake pipe I to be discharged to the outside. Therefore, a negative pressure is generated in the intake pipe I. The air between the check valve 200 and the PCSV 100 flows into the intake pipe I by the negative pressure generated in the intake pipe I. As a result, the negative pressure is generated between the check valve 200 and the PCSV 100.

In the stopping S200, the PCSV 100 is opened and closed to have a cycle, such that the outside air through a vent valve connected to the canister 300 is supplied between the check valve 200 and the PCSV 100 through the purge line 500. As a result, the pressure between the check valve 200 and the PCSV 100 is changed from the negative pressure to the atmospheric pressure. In the stopping S200, the PCSV 100 is duty-controlled to be opened and closed with a cycle.

Figure 3:
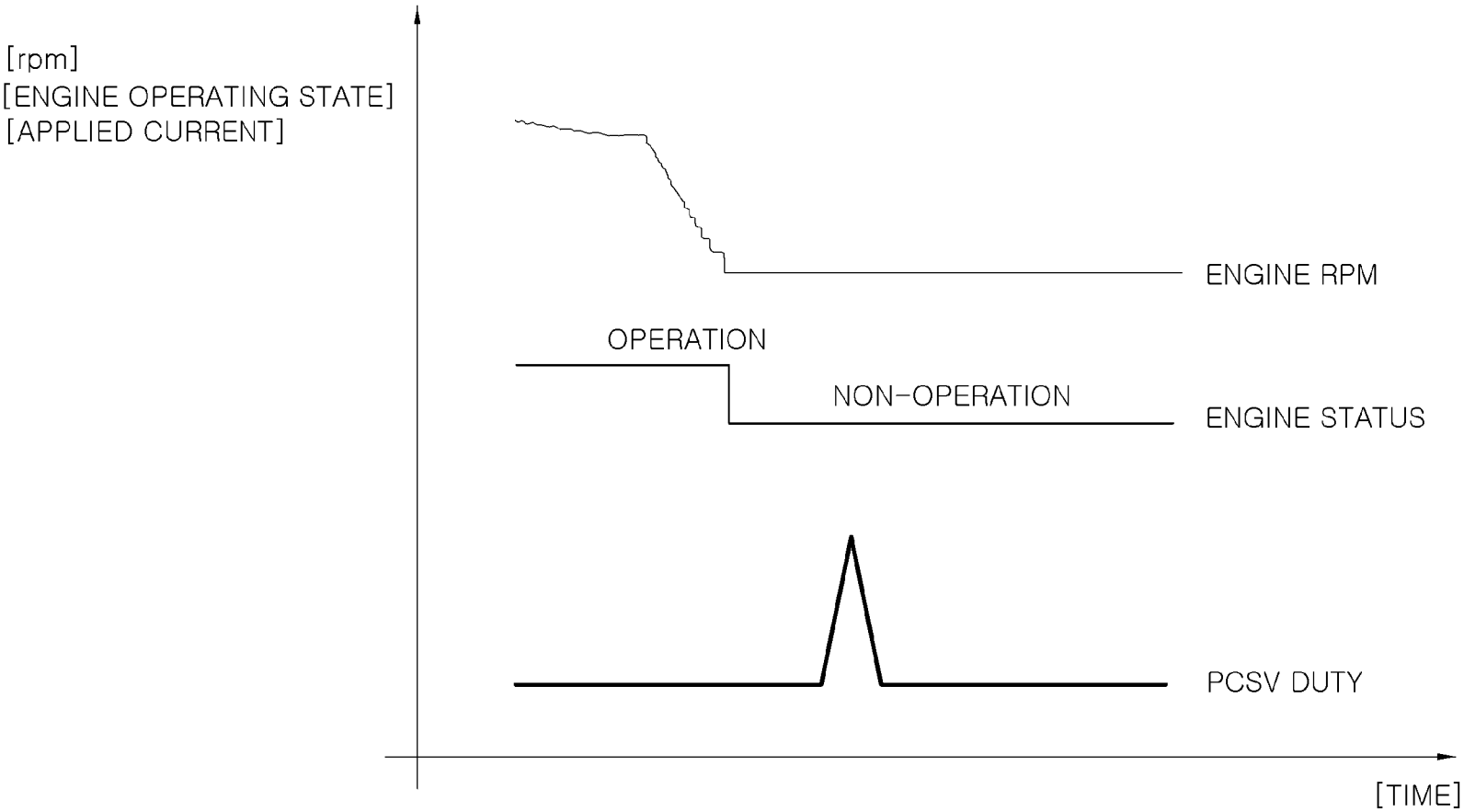
FIGS. 3 and 4 are graphs illustrating the stopping of FIG. 1.

According to one example, in the stopping S200, the PCSV 100 is opened and closed to have a cycle after the engine is started off and the rotation of the crankshaft C has been stopped. As illustrated in FIG. 3, in the stopping S200, the PCSV 100 is duty-controlled to be opened and closed at least once every 0.2 second cycle from the time point when the rotation of the crankshaft C has been stopped and one second has elapsed. The PCSV 100 can also be opened and closed once. In the stopping S200, the time that maintains the opened state and the closed state while the PCSV 100 is opened and closed with a cycle can be 0.

Figure 4:
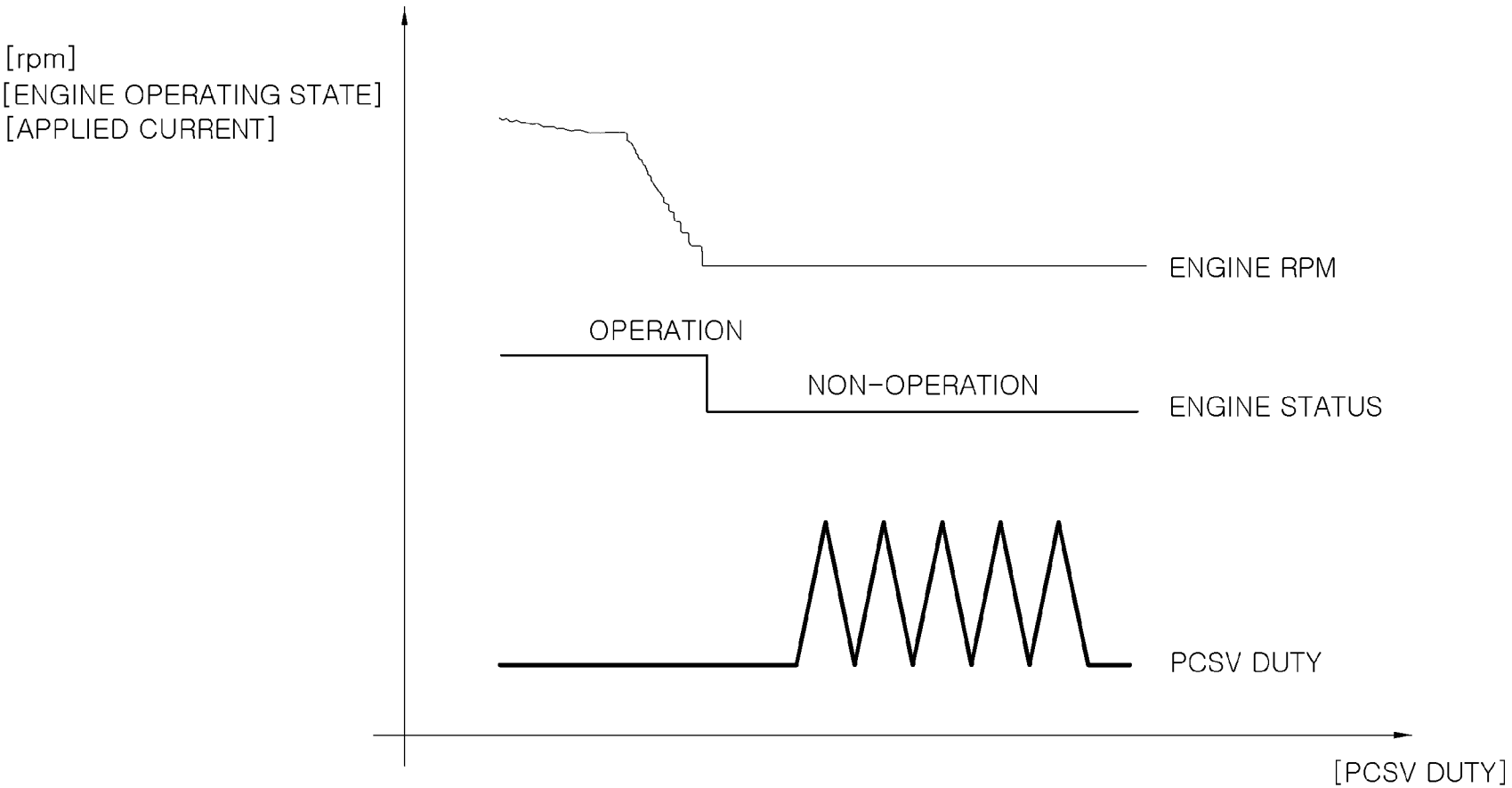

According to another example, as illustrated in FIG. 4, in the stopping S200, the PCSV 100 can also be duty-controlled to be opened and closed at least once every 0.41 second cycle from the time point when the rotation of the crankshaft C has been stopped and three seconds have elapsed. In this case, the PCSV 100 can be opened and closed five times or more. In the stopping S200, the time that maintains the opened state and the closed state while the PCSV 100 is opened and closed with a cycle can be 0.

The PCSV 100 control method for preventing malfunction in one form of the present disclosure configured as described above is provided in a state stored in a control unit 600 illustrated in FIG. 5. The control unit 600 controls the operation of the PCSV 100 according to the PCSV 100 control method for preventing malfunction.

According to the PCSV control method as described above, in the starting-up S100, it is possible for the PCSV 100 to be opened and closed to eliminate the foreign substances stained on the surface of the PCSV 100 while stopping, thereby preventing the malfunction or non-operation of the PCSV 100 caused by the foreign substances fixed to the surface of the PCSV 100 upon stopping.

In addition, in the stopping S200, it is possible for the PCSV 100 to be opened and closed to have a cycle to eliminate the negative pressure between the PCSV 100 and the intake pipe I, and thereby to allow the negative pressure generated inside the line for connecting the check valve 200 and the PCSV 100 to operate on the airtight portion of the PCSV 100, thereby preventing the foreign substances from being absorbed more strongly.

In addition, in the starting-up S100 and the in the stopping S200, it is possible to operate the PCSV 100 for a short time, thereby generating less noise.

What is claimed is:

1. A Purge Control Solenoid Valve (PCSV) control method for preventing malfunction, the method comprising:

starting-up, by a starting motor, a rotation of a crankshaft of an engine, opening the PCSV by a duty-control to eliminate foreign substances stained on the PCSV, and stopping the engine and controlling the PCSV to be opened and closed with a cycle via the duty-control, and wherein in stopping the engine, the PCSV is controlled to repeat the opening and closing with the cycle so as to eliminate a negative pressure between the PCSV and an intake pipe of the engine.

2. The PCSV control method of claim 1, wherein in the starting-up, when a temperature of coolant of the engine or a temperature of a region where a vehicle is located is smaller than an appropriate value, or exceeds a threshold, the PCSV is duty-controlled to be closed.

3. The PCSV control method of claim 1, wherein in the starting-up, when an operating time point of the starting motor from a time point when the rotation of the crankshaft has been stopped is smaller than a specific time, the PCSV is duty-controlled to be closed.

4. The PCSV control method of claim 1, wherein in the starting-up, the PCSV maintains the opened state for a certain time from a rotation starting time point of the crankshaft.

5. The PCSV control method of claim 4, wherein the certain time is shorter than a time between the rotation starting time point of the crankshaft and a time point when the engine is started-up and then revolutions per minute (RPM) of the engine is stabilized.

6. The PCSV control method of claim 1, wherein in the starting-up, the PCSV is duty-controlled to become a predetermined opening amount.

7. The PCSV control method of claim 1, wherein a compressor for compressing an intake air is mounted on the intake pipe, wherein a check valve for preventing the intake air from flowing into the PCSV from the intake pipe is mounted between the PCSV and the intake pipe, and wherein in stopping the engine, while repeating opening and closing the PCSV with the cycle, a negative pressure between the check valve and the PCSV becomes equal to an atmospheric pressure.

8. The PCSV control method of claim 1, wherein in stopping the engine, the PCSV is duty-controlled to be opened and closed at least once with any cycle from a time point when the rotation of the crankshaft has been stopped.

9. The PCSV control method of claim 1, wherein in stopping the engine, the PCSV is duty-controlled to be opened and closed at least once with any cycle from a time point when the rotation of the crankshaft has been stopped and a specific time has elapsed.

10. The PCSV control method of claim 8, wherein in stopping the engine, a time that maintains an opened state and a closed state while the PCSV is opened and closed with any cycle is 0.

11. The PCSV control method of claim 9, wherein in stopping the engine, a time that maintains an opened state and a closed state while the PCSV is opened and closed with any cycle is 0.

12. The PCSV control method of claim 1, wherein in stopping the engine, the PCSV is duty-controlled to be opened and closed with the cycle after the engine is started off and any time has elapsed.

13. A control unit including a processor configured to operate the PCSV according to the PCSV control method of claim 1.

* * * * *